United States Patent [19]

Fedor et al.

[11] 3,968,960

[45] July 13, 1976

[54] SHEET INVERTING AND STACKING APPARATUS

[75] Inventors: John Fedor; James V. Vetrone, both of Vestal, N.Y.

[73] Assignee: International Business Machines Corporation, Armonk, N.Y.

[22] Filed: Dec. 11, 1974

[21] Appl. No.: 531,510

[52] U.S. Cl. ..... 271/187; 271/69

[51] Int. Cl.[2] ..... B65H 29/40

[58] Field of Search ..... 271/69, 80, 82, 178, 271/186, 187

[56] References Cited

UNITED STATES PATENTS

| | | | |
|---|---|---|---|
| 2,421,874 | 6/1947 | Fouse | 271/69 |
| 2,904,334 | 9/1959 | Condall et al. | 271/69 |
| 3,046,008 | 7/1962 | Velvel | 271/186 |
| 3,062,537 | 11/1962 | Hanstein et al. | 271/187 |
| 3,084,932 | 4/1963 | Schiller et al. | 271/186 |
| 3,365,193 | 1/1968 | Davis, Jr. | 271/178 |
| 3,840,222 | 10/1974 | Fowlie et al. | 271/186 |

*Primary Examiner*—John J. Love
*Assistant Examiner*—Robert Saifer
*Attorney, Agent, or Firm*—Kenneth P. Johnson

[57] ABSTRACT

Apparatus for inverting and stacking sheets successively conveyed along a path. Each sheet is sensed and actuates an inverting means which causes an element to engage and slow the leading edge of the sheet at a discharge region and deflect it from the path to a stacking platform. The trailing portion of the sheet continues to be moved by conveying means at approximately its original velocity and moves past the leading edge so that the sheet is rolled over and deposited in an inverted position on the stacking support or preceding sheet. The stacking support is sloped upward at its outer edge to facilitate removal of a portion of the stacked sheets while continuing the stacking operation. The conveying means extend over the stacking support to insure that the shorter sheets as well as the longer ones are properly deposited on the stack. By using a plurality of sheet engaging elements on the inverting means, sheets having a wide range of sizes can be deposited on the stack.

4 Claims, 6 Drawing Figures

SHEET INVERTING AND STACKING APPARATUS

BACKGROUND OF THE INVENTION

This invention relates to sheet stacking apparatus and more particularly to stacking apparatus in which sheets are successively inverted as they are deposited on the stacking platform. Stacking devices are known which can engage the leading edge of sheets moved along a path and divert the leading edge from the path so that the trailing portion of the document is pushed beyond the leading edge causing a sheet to be turned over. Such apparatus is exemplified by U.S. Pat. Nos. 2,649,303 and 2,904,334. The apparatus described by these patents has been devised to handle sheets of uniform size and having a relatively high degree of stiffness. Certain stacking requirements, however, demand the capability of being able to reliably invert sheets having the stiffness of punched card stock or tissue paper having a weight range of 140 No. (0.010 in. thickness) down to 10 No. (0.0018 in. thickness) or even greater range. In addition the stacker should have the capability of handling sheets of small, postal card-size to newspaper size, as encountered in handling printer output. A further requirement is that of permitting removal of a partial stack of sheets while the stacking operation continues uninterrupted.

OBJECTS

It is accordingly a primary object of this invention to provide stacking apparatus in which sheets of various sizes and weights can be reliably inverted and stacked.

A further object is to provide apparatus which is capable of stacking sheets of differing, intermixed physical characteristics.

Still a further object of this invention is to provide an inverting stacking apparatus for sheets in which the leading edge of a sheet is deflected from the transport path and a plurality of conveying means are used to roll the trailing portion of the sheet past the leading edge to cause sheet turnover.

Another object of this invention is to provide an inclined stacking platform which retains stacked sheets thereon and yet permits removal of the sheets during stacking.

A still further object of this invention is to provide an inverting stacking apparatus in which sheet conveying means extend beyond the sheet discharge region and over the stacking platform to insure complete roll over of sheets deposited on the stack.

SUMMARY OF THE INVENTION

The foregoing objects are attained in accordance with the invention by providing stacking apparatus which conveys sheets successively along a path where sheet presence is sensed so that at a subsequent discharge region the leading edge of each sheet is engaged with deflecting means to divert the edge from the path to the stacking platform. A pair of conveying means continues to urge the trailing portion of the sheet along the path at the discharge point where one conveying means terminates and the second continues to urge the trailing portion of the sheet along the path over the deflected leading edge to thereby turn over the sheet and roll it out onto the stacking platform. The second conveying means, because of its extension over the stacking platform, is able to insure the turn over of large-sized sheets and sheets having little body or stiffness. The deflecting means engaging the leading edge of the sheets decelerates that portion while permitting the trailing sheet portion to be conveyed at or near its usual velocity. After each sheet has passed the point where its presence has been sensed, the edge deflecting means moves to a position in which the leading edge of a succeeding sheet can be engaged.

An inverting stacker has the advantages of avoiding interference between feed holes along the sides of the sheets as often encountered in handling output documents from a printer. Further advantages are the reduction of static electrical charges on the sheets and avoidance of the possibility of smearing wet ink due to sliding one sheet over another. By extending the conveying means beyond the discharge point and maintaining the constant forward velocity for each sheet, complete turn over of each sheet is insured and accurate placement is maintained on the stacking platform. In addition, the edge deflecting means includes a plurality of engaging elements so that sheets of small size can be handled at a greater rate, since one element may be just disengaging from a stacked sheet when a succeeding sheet is approaching the discharge point. Such apparatus eliminates the necessity of several adjustments normally required of an operator to accommodate variable sheet sizes during a stacking operation. An inclined stacking platform, by urging the sheets toward the rear of the platform, enables removal of groups of sheets from the stack without interfering with the stacking operation.

The foregoing and other objects, features and advantages of the invention will be apparent from the following more particular description of a preferred embodiment of the invention as illustrated in the accompanying drawing.

DESCRIPTION OF PREFERRED EMBODIMENT

Figure 1:
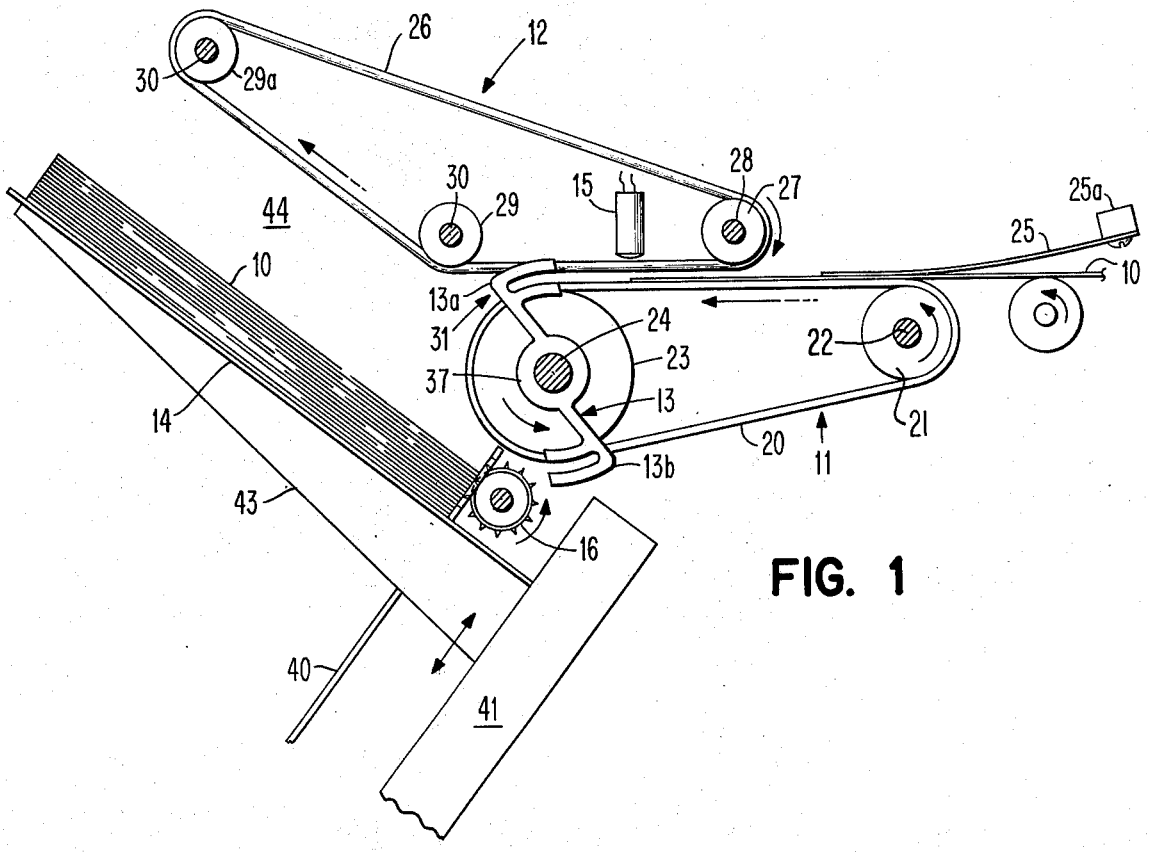
FIG. 1 is a side elevation view of the stacking apparatus constructed in accordance with the principles of the invention.
Figure 2:
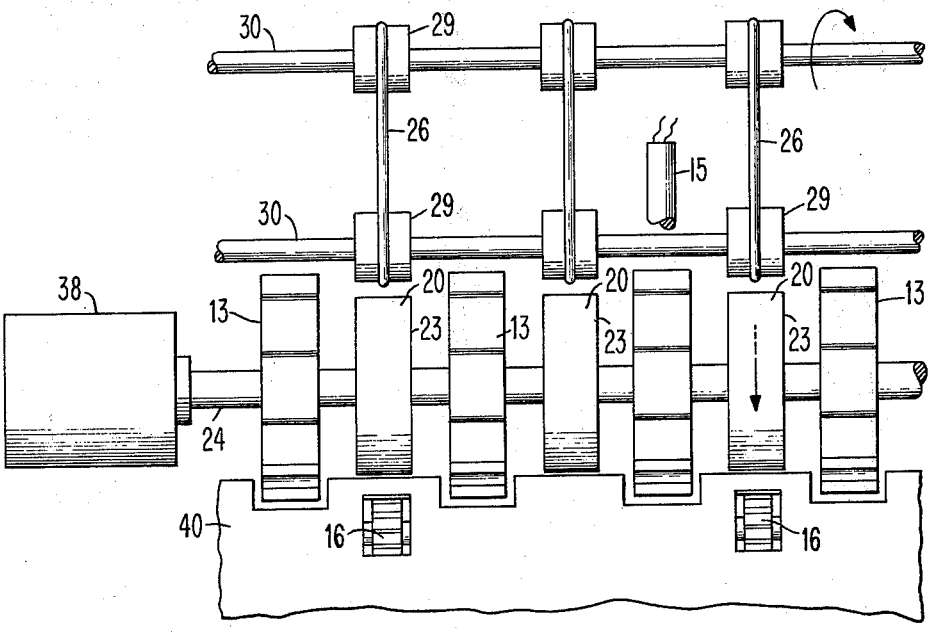
FIG. 2 is a front elevation view of the stacking apparatus in FIG. 1 showing the sheet edge deflecting means and conveing means of FIG. 1.

Referring to FIGS. 1 and 2, apparatus for stacking sheets 10 comprises generally a lower transport means 11, upper transport means 12 moving in synchronism with the lower transport means, sheet deflecting elements 13, a movable stacking platform 14, a sheet sensing device 15, and a rotatable roll 16 for urging deposited sheets onto the stacking platform.

Sheets 10 are successively deposited by means not shown on transport belts 20 which are mounted on driving pulleys 21 fixed to shaft 22 and driven pulleys 23 freely rotatable on shaft 24. Transport belts 20 are made of a material having a relatively high coefficient of friction so as to carry the sheets deposited thereon. In order to urge sheets into contact with belts 20, a plurality of flexible straps 25 may be attached to a common support bar 25A across the sheet path and arranged to merely lie on the belts.

A second plurality of transport belts 26 are located above the first plurality of belts 20 and are adjacent for a limited distance along the effective length of belts 20. Second belts 26, however, being continuously driven by pulleys 27 affixed to driven shaft 28, extend beyond the discharge point of belts 20. Belts 26 are guided about idler rollers 29 freely rotatable on the shafts 30. Belts 26 are driven at the same surface velocity as belts 20 and are located adjacent thereto along their common sheet path so as to insure engagement of one or the other with sheets moved therealong. Upper belts 26 may be spaced above belts 20 a distance equal to the thickness of a sheet or several times the sheet thickness. However, the spacing will be determined by the susceptability of the sheets to ink smudge and stacking characteristics. As with belts 20, belts 26 have a high friction surface and may be circular in cross-section, although belts of other cross-section are also operable. Shafts 22 and 28 may be driven from the same power source.

As sheets 10 are moved to the left in FIG. 1 nearing a discharge point designated generally as 31, the leading edge of the sheet engages a plurality of edge deflecting elements 13 each having diametrically opposed, bifurcated end portions 13*a* and 13*b* extending from common hub 37. Deflecting elements 13 are fixed to shaft 24 which is driven by a drive means 38. The drive means is preferably a servo or stepping motor which can be controlled to rotate a portion of a revolution, as will be explained hereinafter. The edge deflecting elements are controlled through motor 38 (FIG. 2) to move in the direction of the sheet travel at the time of engagement but at a velocity slightly less than the surface velocity of belts 20 and 26.

With this difference in speeds, the edge engaging elements deflect the edge of a sheet downward at discharge region 31 and the belts urge the remaining portion of a sheet past the leading edge to cause inversion of the sheet. As will be subsequently described, shaft 24 is rotated sufficiently so that end portions 13*a* engaging a sheet moves to permit the leading edge of the sheet to abut a back plate 40 of stacker platform 14. Plate 40 is notched appropriately at the location of each edge engaging element 13 so that the elements can pass beyond the plate, while the edge of the sheet strikes the plate. During a stacking operation, however, elements 13 stop at the point at which a sheet engages plate 40 and wait until the following portion of the sheet is moved outwardly past the discharge point 31. Thereafter elements 13 are moved so as to be in an edge engaging position for a subsequent sheet.

Stacking platform 14 is mounted for movement along base member 41 so as to accommodate a sheet stack of increasing size as sheets accumulate thereon. During the stacking operation, continuously rotating rolls 16 having a friction surface on their periphery are used to urge the leading edges of deposited sheets onto the stack. Stacking platform 14 is secured to supporting arms 43 which, in turn, move within frame member 41 so as to maintain the top of the stack at substantially the same point. Such arrangements are well-known in the art and the supporting arms may be either positively driven or resiliently supported to move within the frame member to accommodate the increasing stack size.

It is to be noted that stacking platform 14 and the supporting mechanism therefor are arranged so that the outer or left end in FIG. 1 is tilted upwardly. The amount of tilt is that required to insure that sheets on the platform gravitate toward back plate 40. This arrangement enables removal of a portion of the incoming sheets as they are being stacked without having to temporarily discontinue the stacking process. It is preferable that the region 44 of conveying belts 26 extends along a line substantially parallel with the stacking platform 14. This will insure that belts 26 will be able to convey the trailing portions of large sheets far enough to achieve complete turnover of the sheet during a stacking operation.

The control of motor 38 for moving edge engaging elements 13 is under the control of a sheet sensor 15 and a document length switch described below. The sensor is an optical element containing both a light source and detector which is activated by light reflected from sheets moving along the path. Other types of sensors such as pneumatic or mechanical levers may also be used.

Figure 3:
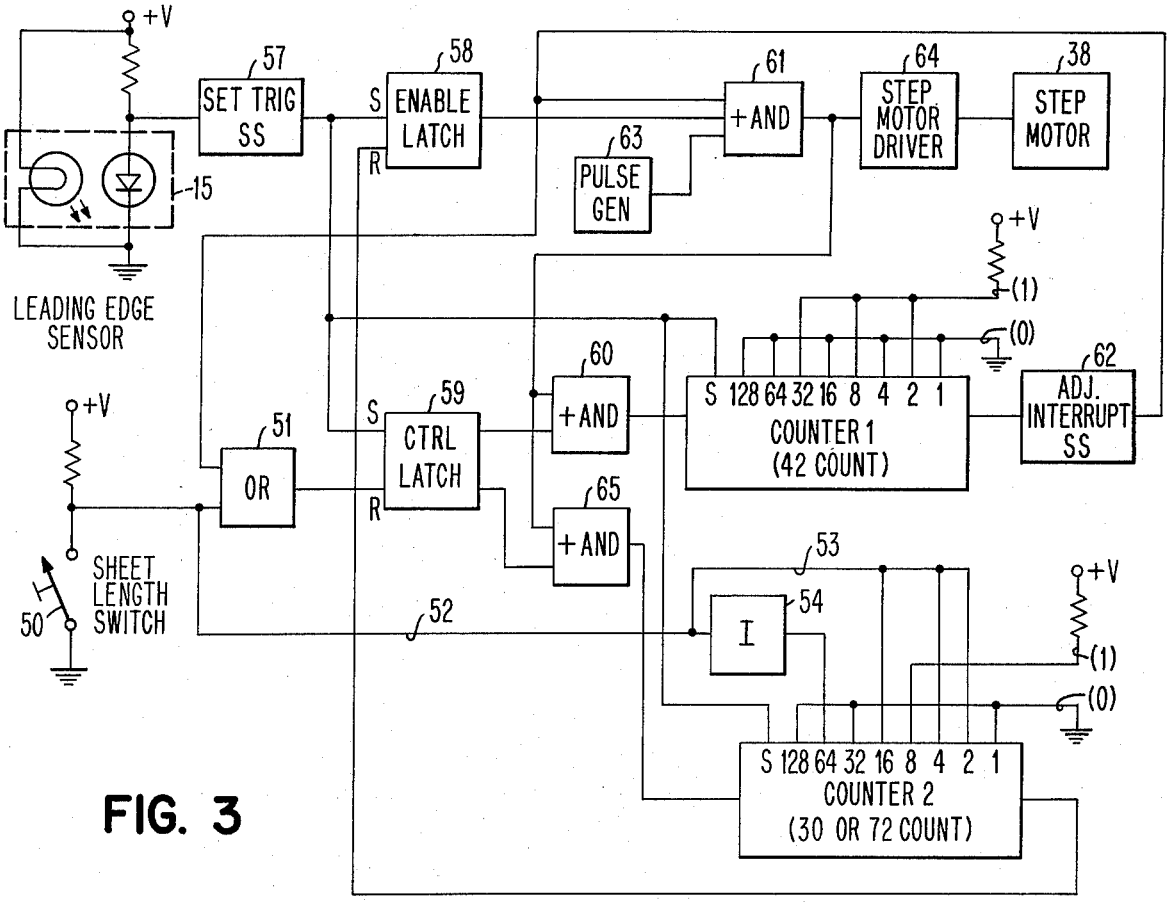
FIG. 3 is a schematic diagram of a control circuit used in conjunction with the apparatus of FIG. 1.

Referring to FIG. 3, there is shown an example of a circuit that may be used to control the positioning of edge engaging elements 13 to intercept sheets moving along the paper path and deflect the sheet edges against back plate 40. The circuit is disclosed as composed of logic blocks and circuits well-known in the art. The description of the circuit assumes that sheet engaging elements 13*a* and 13*b* are in the position shown in FIG. 1 in which 13*a* is in the path of an advancing sheet.

The circuit requires the setting of a Document Length switch 50 for either a long or short document, a long document being greater than the circumferential distance between two sheet engaging elements 13*a* and 13*b* and a short document being less than that circumferential distance. For this example, switch 50 will be assumed to be in the open position indicating that long sheets are to be stacked. With switch 50 open, a high level potential will be supplied to OR circuit 51, lines 52 and 53, and Inverter 54. The inverter output level will be low. The potential level on lines 53 are supplied to binary Counter II which can be set at counts of either 30, in the case of long sheets, or 72 for short sheets. The high level on line 53 along with appropriate high levels on the 0 or 1 input lines from some suitable potential source, not shown, will serve to set the counter to the desired count upon receipt of a set signal. Likewise, a binary Counter I which is set at a count of 42 is also connected to the source of potential, not shown, to provide that count when the counter is set.

As a sheet moves along the path toward sheet engaging elements 13*a*, its leading edge passes under optical detector 15 so that a negative going signal is generated at Set Trigger single shot 57 which, in turn, produces a negative going output to set Enable Latch 58. The output from Trigger 57 is also supplied as a set signal to both Counters I and II to enter the designated count. The pulse from Trigger 57 is also supplied to set Control Latch 59 so that a positive going output level is supplied to AND gate 60.

With latch 58 set, its output conditions one input to AND 61. A second high level input is supplied from Adjustable Interrupt single shot 62 and may be assumed to be present at this time. A third input is from Pulse Generator 63. AND 61 is now able to supply successive pulses to Step Motor Driver 64 and, in turn, to Step Motor 38 to cause the motor to incrementally advance, for example, 2.5° per step and rotate engaging element 13*a* counterclockwise in FIG. 1 toward back plate 40. Increments of other sizes can be readily used by adjusting the stored count.

Pulses from AND 61 are also supplied to AND 60 which is already conditioned so that the pulses are supplied to Counter I as decrementing pulses. AND 61 continues to supply pulses until Counter I reaches zero count whereupon an output signal is generated that is supplied to Interrupt 62. This causes the interrupt single shot to produce a low level output signal which temporarily removes the conditioning signal from AND 61, thereby blocking pulses from generator 63, and supplies a reset signal through OR 51 to Control Latch 59. At this time, sheet edge engaging element 13*a* has carried the leading edge of the sheet to a point where it abuts back plate 40 in FIG. 1. Belts 20 and 26 continue to drive the trailing portion of the sheet over and beyond the stalled leading edge until the sheet is inverted and lying on stacking platform 14 or the stack thereon.

The low, blocking output from Interrupt 62 in FIG. 3 is set to continue for the time necessary to insure that edge engaging element 13*b*, which has been moved toward the sheet path, will not interfere with the continued feeding of the sheet being stacked. Therefore Interrupt single shot 62 is made adjustable and is set according to sheet length. The blocking output signal from Interrupt 62 is only temporary and at the end of its blocking time the output level returns to that which is sufficient to again enable AND 61 to allow pulse generation. Since Control Latch 59 was reset by Interrupt 62, its output now blocks AND 60 and conditions AND 65. The pulses from AND 61 continue to Step Motor 38 and also now decrement Counter II from its original preset count of 30. When this counter reaches zero an output signal is generated which is then supplied to reset Enable Latch 58 and terminate further pulse generation.

When sheets are to be stacked which are shorter than the circumferential distance between edge engaging elements 13*a* and 13*b*, sheet length switch 50 is moved to its closed position. This applied a continuous low level input to OR circuit 51 to prevent setting of latch 59 and also on lines 52, 53 and to Inverter 54. The output on Inverter 54 as a result assumes a high level as an input to indicate a count in Counter II. When the shorter sheets are fed along the document path, the leading edge is detected by sensor 15 to thereby activate Set Trigger 57 whose output, in turn, sets Enable Latch 58 and attempts to set Control Latch 59 which is blocked. Thus AND 65 is conditioned. The output from trigger 57 also provides a set pulse for Counter I and Counter II. However, in this case, the count entered in Counter II is 72 due to the signal level on lines 52, 53. When Enable Latch 58 is set, its output enables AND 61 so that along with the high level output from Interrupt 62, AND 61 gates pulses from generator 63 to produce activating pulses for Step Motor 38 and also to enable AND 65. Since Control Latch 59 is in its reset state, AND 60 is not conditioned and Counter I will not be decremented. The pulses supplied to AND 65 will decrement Counter II from its count of 72. Upon reaching zero count, the output pulse from Counter II resets latch 58 to disable AND 61 and terminate pulse generation. When processing sheets of the shorter length, it will be noted that Interrupt single shot 62 is not used. At 2.5° per step count of 72 increments is sufficient in the embodiment of the invention as disclosed to rotate sheet engaging elements 13*a* and 13*b* 180°. With the short sheets the sheet engaging elements continue moving until one is again in the engaging position.

Figure 4A:
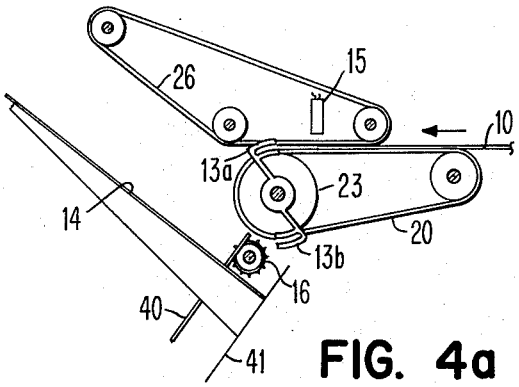
FIGS. 4*a*, 4*b* and 4*c* are progressive schematic illustrations of a stacking operation by the mechanism of FIG. 1.
Figure 4B:
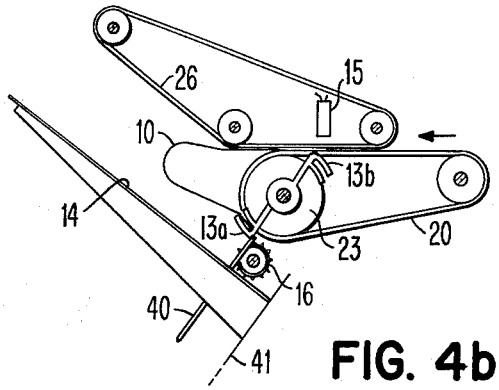
Figure 4C:
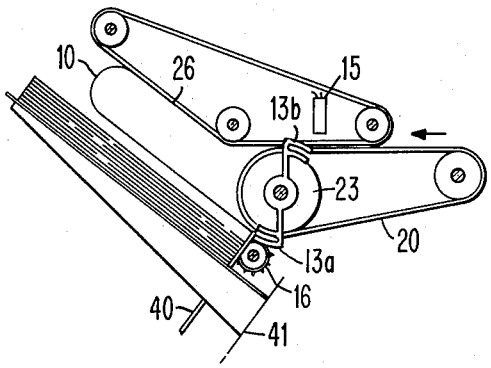

A resume' of the operation of the stacking apparatus will be given with reference to FIGS. 4*a*, 4*b* and 4*c*. In FIG. 4*a*, a sheet 10 is transported between lower and upper conveying belts 20 and 26 toward a discharge point over the edge of pulley 23 at the velocity of the transport belts. As the leading edge of sheet 10 passes underneath sensor 15, the actuating motor for edge engaging elements 13 start to rotate the elements in the direction of sheet travel. However, the elements move at a velocity slightly less than that of the moving sheet and cause the trailing portion of the sheet to move beyond the leading edge. In FIG. 4*b*, belts 20 and 26 continue to drive sheet 10 forward while the leading edge engaged by element 13*a* is stopped at back plate 40 of the stacking platform 14. Element 13*a* is held in this position because of the possible interference of opposite edge engaging element 13*b* with the trailing portion of the sheet. After a delay set by adjustment of the Interrupt single shot 62 in the circuit of FIG. 3, the actuating motor for engaging elements 13 is advanced to bring engaging element 13*b* into the position originally occupied by element 13*a*. The amount of delay necessary is that to insure clearance of the trailing edge of sheet 10 as the element moves into the sheet path.

In the embodiment shown, edge engaging elements 13*a* and 13*b* are diametrally disposed. The invention need not use opposite edge engaging elements but can have varying numbers such as a single element or three or more radially disposed engaging elements. The number of elements depends upon the sheet length to be handled and the peripheral distance between two adjacent elements. A device with a single edge engaging element can be used when sheets to be handled thereby are of a length long enough to allow the element 13 to complete a full revolution before the following sheet arrives at the sensing station.

While the invention has been particularly shown and described with reference to a preferred embodiment thereof, it will be understood by those skilled in the art that the foregoing and other changes in form and details may be made therein without departing from the spirit and scope of the invention.

What is claimed is:

1. Apparatus for stacking a sheet conveyed along a path to a discharge region comprising:

a stacking platform for receiving said sheet;

first means for conveying a sheet along a path to said discharge region adjacent said stacking platform;

means at said discharge region operable for deflecting the leading edge of a moving sheet from said path to said stacking platform;

control means energized by said sheet at a designated location in said path for operating said deflection means, said control means being settable to alter the movement of said deflecting means in accordance with the length of said sheets; and second conveying means at said discharge region for engaging and moving the trailing portion of said sheet beyond said deflected leading edge to thereby invert said sheet.

2. Apparatus for stacking a sheet conveyed along a path to a discharge region comprising:

a stacking platform for receiving said sheet;

first means for conveying a sheet along a path to said discharge region adjacent said stacking platform;

edge-engaging means at said discharge region operable for deflecting the leading edge of a moving sheet from said path to said stacking platform, said edge-engaging means including elements rotatably and diametrally disposed about an axis;

control means energized by said sheet having designated location in said path for operating said edge-engaging means and including circuit means for moving said elements through arcs of different predetermined lengths depending upon the length of the sheet; and second conveying means at said discharge region for engaging and moving the trailing portion of said sheet beyond said deflected leading edge to thereby invert said sheet.

3. Apparatus as described in claim 2 wherein said control means further includes a pulsed actuator for moving said edge-engaging means and a sheet detector means for controlling the application of pulses to said actuator.

4. Apparatus for stacking a sheet conveyed along a path to a discharge region comprising:

a stacking platform for receiving said sheet;

first means for conveying a sheet along a path to said discharge region adjacent said stacking platform;

means at said discharge region operable for deflecting a leading edge of a moving sheet from said path to said stacking platform;

control means energized by said sheet at a designated location in said path for operating said deflection means, said control means including a pulse generator circuit, an actuator connected to said deflecting means and operable in response to said pulses, a pulse counter, and edge detector means for supplying pulses to said actuator and said counter until said counter reaches a preset condition to block further pulses; and second conveying means at said discharge region for engaging and moving the trailing portion of said sheet beyond said deflected leading edge to thereby invert said sheet.

* * * * *